United States Patent [19]

Daleo

[11] 4,260,089

[45] Apr. 7, 1981

[54] SHOULDER HOLSTER WITH MEANS TO SECURE THE SAME TO WEARER'S GARMENT

[76] Inventor: Joseph Daleo, 156 E. 3rd St., Deer Park, N.Y. 11729

[21] Appl. No.: 4,682

[22] Filed: Jan. 19, 1979

[51] Int. Cl.[3] ..... A45F 5/02; F41C 33/02

[52] U.S. Cl. ..... 224/206; 224/264; 224/911

[58] Field of Search ..... 224/911, 912, 914, 150, 224/191, 192, 193, 197, 202, 203, 205, 206, 246, 264, 269; 24/201 R, 201 A, 203 R, 204, 49 R, 49 K, 49 CC, 65

[56] References Cited

U.S. PATENT DOCUMENTS

| | | | |
|---|---|---|---|
| 518,856 | 4/1894 | Palmer | 224/203 |
| 1,273,201 | 7/1918 | Teuber | 224/264 X |
| 1,781,162 | 11/1930 | Clark | 224/206 |
| 1,917,844 | 7/1933 | Keith | 224/206 X |
| 2,641,760 | 6/1953 | Syracuse | 224/264 X |
| 3,083,885 | 4/1963 | Ware | 224/264 X |

FOREIGN PATENT DOCUMENTS

| | | | |
|---|---|---|---|
| 1171704 | 1/1959 | France | 224/39 |

*Primary Examiner*—David A. Scherbel
*Assistant Examiner*—Jerold M. Forsberg
*Attorney, Agent, or Firm*—Alan K. Roberts

[57] ABSTRACT

A method of securing a holster to the shoulder of a person wearing a neck encircling garment, such as a tie, by encircling the shoulder of the person with a loop and connecting this loop to the neck encircling garment. The loop can be connected to the neck encircling garment with a second smaller loop which engages around the neck encircling garment and which engages in slots formed in the first loop.

1 Claim, 3 Drawing Figures

SHOULDER HOLSTER WITH MEANS TO SECURE THE SAME TO WEARER'S GARMENT

FIELD OF INVENTION

This invention relates to shoulder holsters and to methods and structures for securing the same to a garment of a wearer.

BACKGROUND

Shoulder holsters are known which are provided with loops or straps which are connected thereto by means of rings or like mechanisms. These loops are generally so positioned as to encircle the shoulder portion of a wearer. Usually, these loops are not adequate to hold the holster in position so that a supplemental structure has to be provided to hold the loop and thereby the holster on the shoulder of the wearer. Such supplemental structures usually are provided in the form of elastic straps or the like which extend across the back of the wearer and are looped around the opposite shoulder of the same.

Structures of the above-indicated type are frequently deemed uncomfortable and function to constrict the movement of the wearer. In fact, the elastic bands which extend across the back of the wearer are capable of impairing circulation and causing various types of discomforture as well as adding to an unsightly appearance by being visible through the outer garments of the wearer.

In researching the prior art to determine whether my invention is new, I have not actually found any prior art which might be considered anticipatory. However, for the sake of making complete disclosure, I note the existence of U.S. Pat. No. 723,545 which issued to R. Phillips on Mar. 24, 1903. This patent proposes means whereby a firearm at the convenience of a wearer is held at the belt and when desired can be instantly adjusted to hand immediately under the armpit so that when the user desires to discharge the firearm from the shoulder he can bring it into proper position at the shoulder. A shoulder strap serves as a guide and adjusting device to bring the shoulder piece or stock of the firearm into position in front of the shoulder for aiming and firing. In one embodiment thereof a loop connected to the firearm passes through a loop arranged on the shoulder of the wearer. This second loop while bearing some minimal structural resemblance to the preferred embodiment of my invention is nevertheless remote therefrom as will be seen in the description which follows hereinafter.

SUMMARY OF INVENTION

It is an object of my invention to provide an improved shoulder holster anchoring structure.

It is another object of the invention to provide an improved shoulder holster arrangement which avoids the need for connecting a strap across the back of the wearer whereby both shoulders of the wearer are engaged and the movement of the wearer restricted.

It is another object of the invention to minimize under garment strap arrangements used in connection with shoulder holsters in order to minimize the unsightly display of concealed bands and straps.

It is still a further object of the invention to provide an improved method and technique for mounting a shoulder holster on the person of a wearer.

In achieving the above and other objects of the invention, there is provided an apparatus comprising a flat receptacle such as a gun holster, a strap forming a loop on said receptacle, said loop being adapted to encircle the shoulder region of a wearer, a tie on the neck of said wearer and means on said loop engaging said tie to hold said loop and receptacle on said wearer.

According to a feature of the invention, the aforesaid means may be a second loop encircling the tie of the wearer. Said second loop may be openable and may include locking means to hold the second loop closed. The first loop may be provided with a plurality of slots through which said second loop is selectively engageable.

According to another view of the invention, there is provided an apparatus for use on the shoulder of a person wearing a neck encircling garment, said apparatus comprising a holster, a strap on said holster forming a loop thereon for encircling said shoulder and means on said loop for engaging said garment.

Said means may be an openable loop including locking means. Said openable loop may include two generally rigid end portions, one of said portions being provided with holes, the other of said portions including projections adapted for a snap fit into said holes. Said openable loop may moreover include a textile strip connecting said end portions which may be of a relatively rigid material.

According to a feature of the invention, one of the aforesaid portions may be connected to the textile strip in extension of the same and the other of said end portions may be connected to the textile strip to extend back along the same.

In further accordance with the invention, there is provided a method of securing a holster having a loop thereon to the shoulder of a person wearing a neck encircling garment, said method comprising encircling said shoulder with said loop and connecting said loop with said neck encircling garment.

Other objects, features and advantages of the invention will be found in the detailed description which follows hereinafter as illustrated in the accompanying drawing.

DETAILED DESCRIPTION

Figure 1:
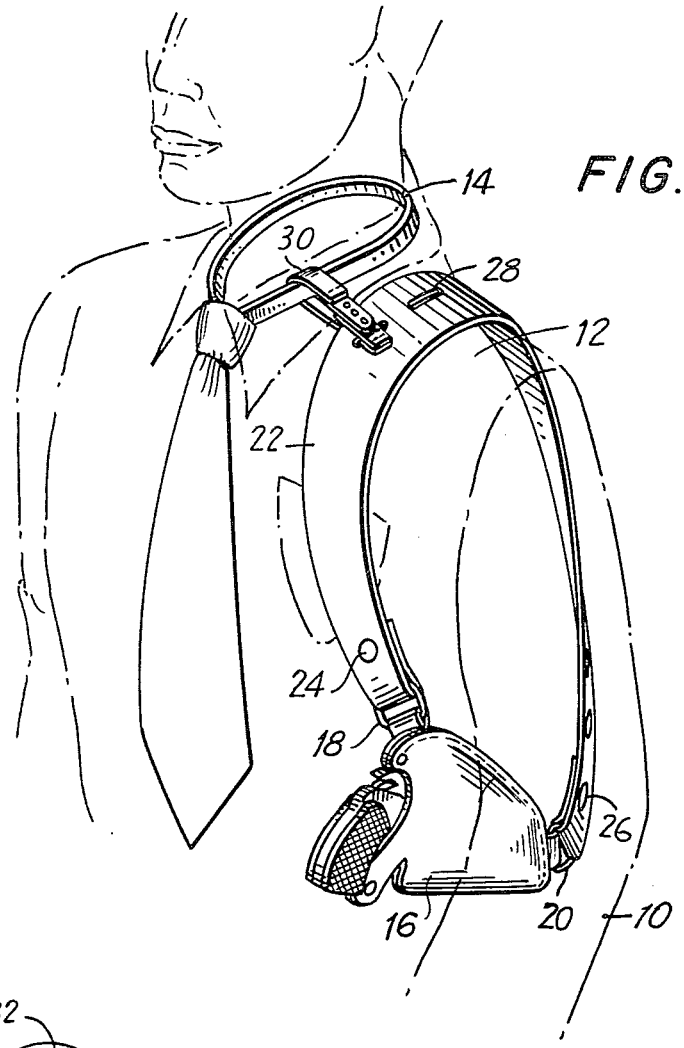
FIG. 1 is a diagrammatic perspective view illustrating how a gun holster may be mounted on the shoulder of a wearer and engaged with a neck encircling garment worn by the wearer.

The drawing illustrates the concept of the invention in a specific form to which the invention is not limited, of a shoulder holster having a loop adapted to engage around the shoulder portion of a wearer with this loop being secured to a necktie or other similar neck encircling garment which is worn by the wearer. The purpose of the engagement with the neck encircling garment is to avoid the need for a back spanning strap which engages the opposite shoulder of the wearer in a conventional shoulder holster arrangement.

More specifically, in the drawing is shown the arm 10 of the wearer, the shoulder portion being indicated at 12 with the wearer having thereon a neck encircling garment or tie 14 which acts as an anchoring device in accordance with the principles of the invention.

Illustrated in FIG. 1 is a flat receptacle 16 which in the preferred embodiment takes the form of a gun holster or the like. Attached to this holster 16 at spaced positions are rings 18 and 20 to which are engaged the end portions of a loop or strap 22 having snap buttons 24 and 26 to make connections with rings 18 and 20.

The holster 16 may be fabricated of leather or plastic or the like and the invention is not limited by the form of or the material from which the holster 16 is made. The loop 22 is in the form of a strap which can be made of leather, plastic, textile or the like.

The loop 22 is provided with a plurality of slots or openings 28, the function of which is to provide for the adjustable attachment of a supplemental belt or loop 30, the purpose of which is to engage around the tie 14 and connect the loop 22 thereto. Loop 30 is relatively short compared with the loop 22 and merely extends between the neck and the shoulder portion 12 of the wearer.

It will be noted that for purposes of mounting the holster 16 on the wearer, the loop 22 is engaged around the shoulder portion of the same and connection is made between loop 22 and the tie 14 and particularly the portion thereof which encircles the neck of the wearer. This anchors the loop 22 on the person of the wearer and prevents the falling of the same from the shoulder portion.

Figure 2:
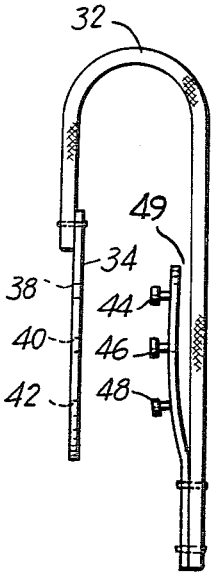
FIG. 2 is a side view of the garment engaging element of the structure illustrated in FIG. 1.
Figure 3:
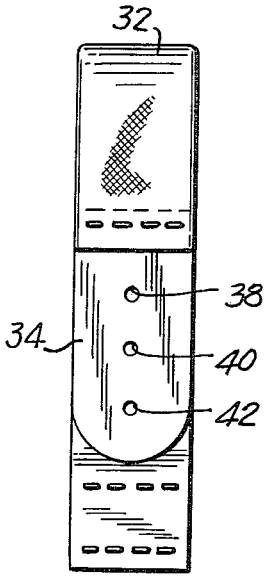
FIG. 3 is a front view of the element of FIG. 2.

FIGS. 2 and 3 show the details of the loop 30 with greater particularity. More particularly, the loop 30 preferably consists of a textile belt or strip 32 to which are connected the relatively rigid end portions 34 and 36 of the loop. The end portion 34 is a relatively rigid portion (compared with the textile strip 32) formed of plastic, hard rubber or the like. It is provided with a plurality of holes 38,40 and 42.

The end portion 36 is similarly of a relatively rigid material such as plastic, rubber or the like. It is provided with a plurality of projections 44,46 and 48 which are of such a size and construction as to be adapted for a snap or press fit into the holes 38,40 and 42 respectively. Thereby, there is formed a locking mechanism whereby the loop 30 which is otherwise openable can be locked in closed position in encircling relationship with the tie 14.

Whereas the end portion 34 is connected in extension of the textile strip 32, the end portion 36 is connected to the textile strip to extend back along the same. This provides for a gap 49 which enables the end portion 36 to be extended through one of the accommodating slots 28 in the loop 22. By this construction, the parts 36 and 32 may lie flatly against the person or body of the wearer and no discomfort will be caused.

It will appear from what has been stated above that an anchoring structure is provided for a shoulder holster which avoids the need for a back scanning strap or belt arrangement and the unsightliness and restriction of movement which is caused thereby.

There will now be obvious to those skilled in the art many modifications and variations of the constructions and techniques set forth hereinabove. These modifications and variations will not depart from the scope of the invention if defined by the following claims.

What is claimed is:

1. Apparatus for use on the shoulder region of a person wearing a neck encircling garment, said apparatus comprising a holster. a strap on said holster forming a loop thereon for encircling said shoulder region, and means on said loop for engaging said garment, said means being relatively short compared with the size of said loop and extending between said neck and shoulder region, said means being an openable loop including locking means, said openable loop including two generally rigid end portions, one of said portions being provided with holes, the other of said portions including projections adapted for a snap fit into said holes, said openable loop including a textile strip connecting said end portions, said end portions being of relatively rigid material, one of said end portions being connected to the textile strip in extension of the same and the other of said end portions being connected to the textile strip to extend back along the same.

* * * * *